United States Patent [19]

Loehle

[11] 4,299,176

[45] Nov. 10, 1981

[54] SAFE PROTECTOR SYSTEM

[75] Inventor: Mary J. Loehle, Covington, La.

[73] Assignee: Badger Safe Protectors, Covington, La.

[21] Appl. No.: 111,777

[22] Filed: Jan. 14, 1980

[51] Int. Cl.[3] ..... E05G 1/12

[52] U.S. Cl. ..... 109/34

[58] Field of Search ..... 109/29, 34, 37, 42

[56] References Cited

U.S. PATENT DOCUMENTS 2,566,587 9/1951 Srygley ..... 109/34

2,804,029 8/1957 Fitzgerald ..... 109/34

FOREIGN PATENT DOCUMENTS 977302 11/1950 France ..... 109/34

*Primary Examiner*—Reinaldo P. Machado

*Attorney, Agent, or Firm*—Keaty & Garvey

[57] ABSTRACT

The invention relates to safe or vault protection system which deters attempt forced entry into the safe or vault by releasing a repulsive chemical agent particularly when peeling the safe door at its edge portion.

7 Claims, 7 Drawing Figures

SAFE PROTECTOR SYSTEM

BACKGROUND OF THE INVENTION

1. Field of the Invention

The present invention relates to safe protection wherein an attempted forced opening of the safe releases a repulsive chemical agent to deter further entry by the burglar. The present invention relates more particularly to a safe or vault protection system which deters attempted forced entry into the safe particularly when peeling the safe door at its edge portions is the attempted means of forced entry.

2. General Background and Prior Art

Presently known in the art is the use of breakable glass vials or tubes filled with repulsive chemical agent located in a metal base attached to the inside of the safe door. The base is so located so that when the combination dial mechanism is hammered or drilled into, or if the mechanism is pulled away from the safe door, a rod leading from the mechanism to the chemical retaining breakable glass vials, and attached to a metal bar or disc, applies pressure to the glass tubes sufficient to break the tubes in the base and release the gas into the atmosphere. Such a prior art type safe protector is seen in U.S. Pat. No. 2,804,029 issued to J. P. Fitzgerald and entitled "Safe Protector".

The present state of the art falls short of the full protection against safe break-ins since the singular use of the glass-tube base mechanism guards only against break-ins through the combination dial mechanism. The present invention is an improvement over such prior art safe protectors by providing a means for protecting against break-ins which occur as a result of forced attempts to "peel" the safe. "Peeling" a safe refers to forced attempts to gain entry to the safe by peeling or forcing the safe door away from its normal position using leverage, crow bars, jacks or the like. In like fashion, peeling refers to attempts to peel back layers of metal and or other materials comprising the safe door, or otherwise forcibly dismantling the door other than the combination dial portion itself.

GENERAL DISCUSSION OF THE PRESENT INVENTION

The present invention provides a safe protection apparatus comprising a metal base adapted to be fastened to the inside of a safe door having a tumbler in line with which the base is fashioned. A sub-assembly provides a pair of molded rubber mounts each of the mounts having a plurality of tube receiving recess openings. A plurality of hermetically sealed tubes containing a repulsive chemical agent (as tear gas) have their ends frictionally fitted into the mount recess openings to form the sub-assembly. The sub-assembly is rewired to the inside of the metal base. Through an opening in the metal base are passed a plurality of pull wires which wrap at one end portion about the plurality of tubes and diverge after exiting the metal base opening to the edge portions of the safe door. During forced entry to the safe, particularly by "peeling" the safe door, the wires are stressed, breaking the tubes at their attachment to the pull wires.

One object of the present invention is to provide a safe protector apparatus to protect a safe from forced break-ins through either the destruction or damage of combination dial mechanism or through "peeling" away portions of the safe door.

Another object of the present invention is to provide a safe protection apparatus utilizing a noxious chemical agent to repulse burglars during forced entry to a safe by either "peeling" the safe door or damaging the combination dial mechanism.

Another object of the invention is to provide for a safe protection apparatus which is easily attached to existing safes.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
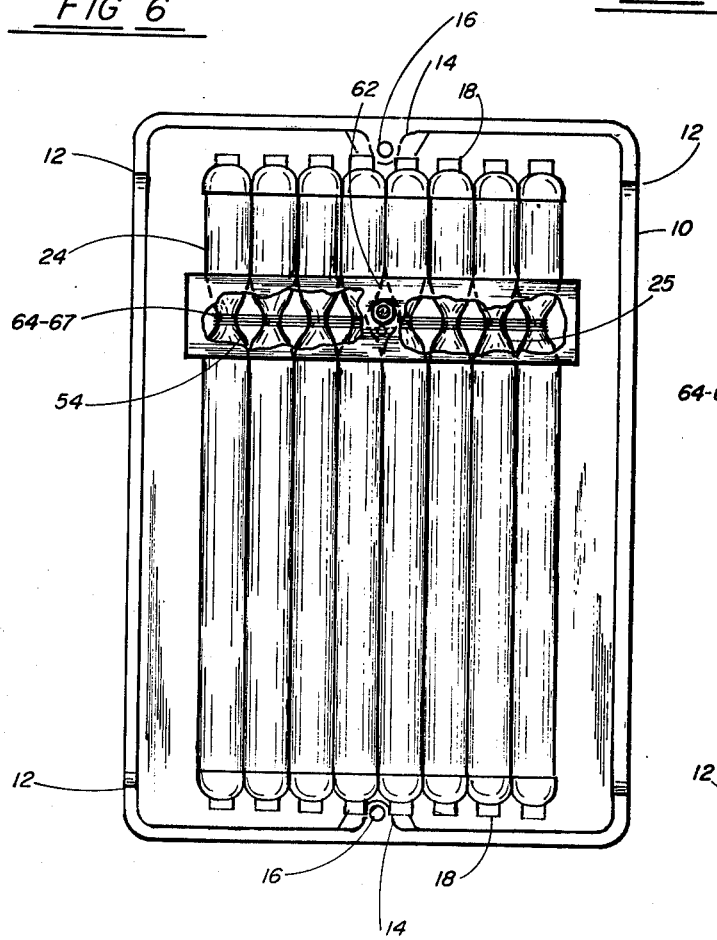
FIG. 1 is a partial front view of the preferred embodiment of the safe protector apparatus, of the present invention, part being broken away and shown in section for sake of illustration.
Figure 2:
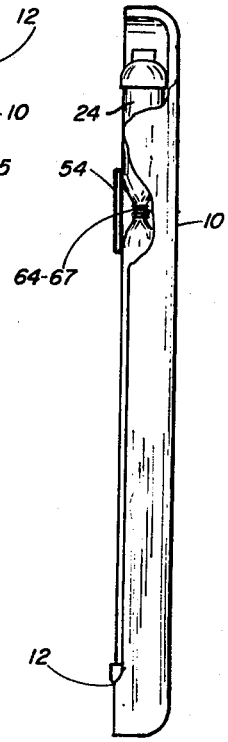
FIG. 2 is a view in side elevation of the safe protector viewed in FIG. 1 with part broken away and shown in section for sake of clarity and illustration.
Figure 4:
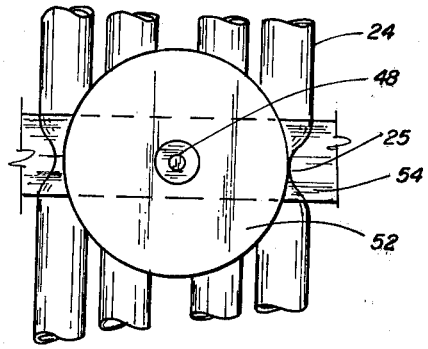
FIG. 4 is a fragmentary view in side elevation of the tube-breaking bars and mounting pin, with base removed.

The safe protector shown in FIGS. 1 and 2 of the drawings has a shallow pan-like metal base 10. The side walls are slightly recessed as indicated at 12 so that when the base 10 is placed against a flat surface such as the inner wall of the door of the safe, there will be opening for the escape of tear gas. At each end of the base 10 there are pads 14 having openings 16 therethrough. The pads 14 serve to absorb the impact of a sudden jolt to the safe door during the normal use of the safe. The openings 16 accommodate screws or the like for fastening the protector to the safe door. The base 10 may be cast or stamped from sheet metal or aluminum casting.

The sub-assembly which is placed in the base consists of a pair of moulded rubber mountings 18 and a plurality of glass tubes 24. The rubber mountings 18 have formed therein recesses 20 for receiving and gripping the ends of the tubes 24. In this embodiment there are eight such recesses. The eight glass tubes 24 are hermetically sealed and contain tear gas or like repulsive chemical agent. Each tube has its end inserted in the recesses 20 of each mounting 18. The diameter of the recesses 20 is such as to frictionally engage the end of the glass tubes 24 and this makes a solid sub-assembly which may be easily stored and handled during other steps of assembly. The rubber mountings of the sub-assembly are adhered to the base with a screw 34 through the base 10. The rubber mountings 18 protect the tubes 24 during such handling and assembly. In addition to this, the rubber mountings 18 project slightly beyond the outer edge of the base 10 so that they act as resilient protectors for the tubes 24 during shipment and installation.

The present invention includes a mechanism for breaking the glass tubes 24 no matter whether the tumbler core is pushed in or withdrawn. To illustrate this embodiment the safe protector is shown secured by screws 34 to the inside of a safe door 36 which includes a combination 38 operated by a dial 40 and a tumbler curb 42. All such parts are shown diagrammatically and the curb 42 is deemed to be connected to the tumbler core of the combination so that movement of the one causes movement of the other. Before securing the safe protector to the door of the safe, the inner wall is drilled to provide a hole 44 for the pin 48 and the curb 42 is drilled and tapped as indicated at 46 to receive the threaded end of a bar operating pin 48. The pin 48 has an outer end of reduced diameter which forms a shoulder 50 at the inner end of the hole 44. The pin 48 is then threaded into fixed place on the curb 42 with its outer reduced and threaded end projecting from the inside of the safe door. A first bar 52 is then placed over the reduced end of the pin 48 so that it will be engaged by the shoulder 50 if the pin 48 is driven inwardly and forced against the tubes 24. The safe protector with a second bar 54 is placed between the vials 24 and the side wall of the base 10. Base 10 is then placed against the door 36 so that the pin 48 projects between the tubes 24, through the bar 54 and into the hole 32. A nut 56 is then threaded on the pin 48 so that if the tumbler core is withdrawn, the pin 48 will cause the bar 54 to smash the vials 24 against the wall of the safe. While not necessary, it is desirable to insert a compression spring 58 on the pin 48 between the bars 52 and 54 to prevent rattling of such bars in normal opening and closing of the safe door. The above safe protection is disclosed in U.S. Pat. No. 2,804,029, issued Aug. 27, 1967 to J. P. Fitzgerald, incorporated herein by reference. It should be understood that the present invention is an improvement to that type of safe protector, in that forced entry to the safe in addition to entry by pushing/withdrawing the tumbler core is protected.

The present invention thus provides a means for protecting against forced break-ins to a safety by "peeling" away the safe door; i.e., deforming, prying, stripping away the metal layers of the door, or otherwise disfiguring the safe door until access is had into the safe. Phantom lines in FIG. 7 illustrate such "peeling" of door 36, or 60.

The stripping method usually occurs from one of the corners of the safe door by utilizing of levers, jacks or other such burglar tools.

Figure 6:
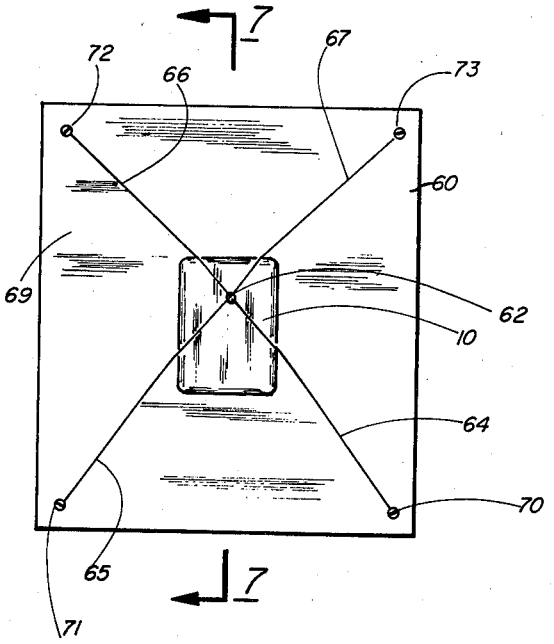
FIG. 6 is an elevational view of a typical safe door illustrating attachment of the preferred embodiment of the apparatus of the present invention attached thereto for operation, and illustrating the pull wires extending from the base portion to the corners of the safe door.
Figure 7:
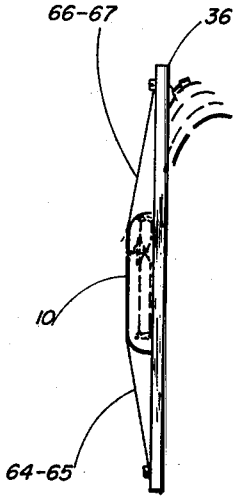
FIG. 7 is a sectional view taken along lines 7—7 of FIG. 6.

FIGS. 1, 6–7 illustrate best the preferred embodiment of the apparatus of the present invention.

Figure 3:
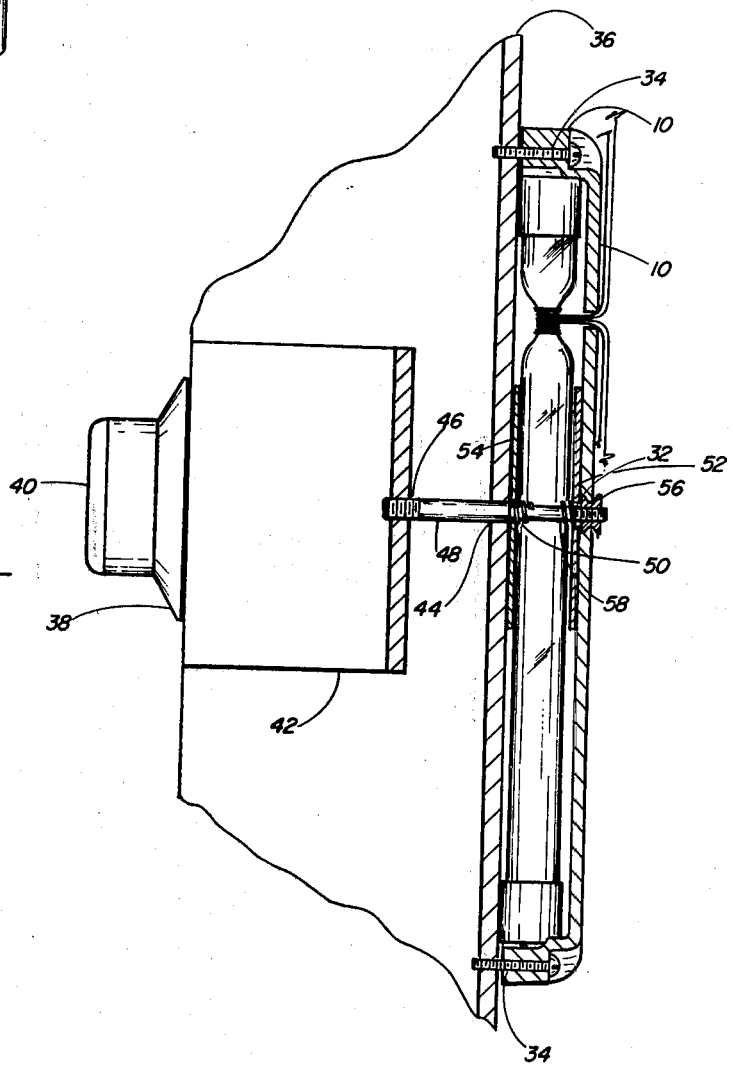
FIG. 3 is a sectional view of a safe protector embodying the present invention mounted on a safe door and showing in particular the tube-breaking metal bars pinned to the curb or tumbler core.
Figure 5:
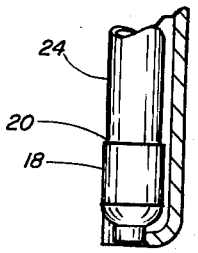
FIG. 5 is a fragmentary section view showing the means of securing the tube pads to the base of the safe protector.

In FIG. 6 there is seen an elevational view of the back 69 of the present invention attached thereto. Extending outward from opening 62 is a plurality of pull wire lines 64–67, which lines are directed to the four corners of the inside layer of metal of the safe door 60 after being pulled taut. It should be noted that opening 62 of base 10 could be an opening 62 independent of opening 32 and should be of a diameter large enough to accommodate the diameters of pull line wires 64–67. Alternatively, hole 32 of base 10 (FIG. 3) could be large enough to accommodate the projection of pin 48 and also accommodate the strands of pull lines 64–67.

FIG. 1 further illustrates the placement of the ends of the lines 64–67 inside of base 10. Each pull line 64–67 is wrapped around the entire assembly of tubes 24 at the area of the recessed neck 25 portion of each tube, so that each strand of wire encircles all tubes 24. Thus the eight tubes 24 would have four strands of wire wrapped around the group of tubes and fastened thereby by tying for example.

The end portion of each pull line 64–67 is affixed to the extreme corner portions of door 60. Attachment to door 60 at corner positions 70–73 is by any suitable means such as screws, eyelets, welding, gluing or the like.

When the "peeling" of door 60 begins, in all probability the peeling will be situated at one of the corners of the safe door or otherwise at the door extremities. When the inner layer 65 of door 60 is peeled away at a corner 70–73 of door 60, the pulling away will produce tension in pull lines 64–67. Since pull lines 64–67 enter base 10 at the center of the base 10 through opening 62 or 32 the pressure on lines 64–67 will pull on all tubes 24. Since the tubes 24 are of a rather thin-walled glass material which is readily breakable, the lines should rupture most if not all tubes 24, thus releasing tear gas or like repulsive chemical agent into the safe and the room. This same occurrence would take place should the peeling occur at any one of the four corners of the safe door. A peeling of the door 60 itself between any two corners will likewise rupture tubes 24 since the two adjacent pull lines would be stressed by such disfiguring of safe door 60.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A safe protector apparatus comprising:

a. an open face metal base adapted to be fastened to the inside of a safe door having a tumbler in line with which said base is fastened, said metal base having a pull line opening therethrough extending away from the safe door to which said base is attached during operation;

b. a sub-assembly having a pair of moulded rubber mounts containing a series of tube end receiving recess openings;

(c) a plurality of hermetically sealed breakable tubes, each of said tubes containing a repulsive chemical agent and having their ends frictionally fitted respectively into said tube end receiving recess openings;

d. a plurality of pull lines affixed to and extending from the four corners of the inside of the safe door over the attached metal base and connected to said plurality of tubes with said metal base,

2. The apparatus of claim 1 which further comprises a cushioning means located between said base and the safe door to which said base is attached for cushioning said tubes against inadvertent breakage.

3. The apparatus in claim 1, wherein each rubber mount is fixedly attached to said base by a screw extending through said base wall and into the rubber mount body.

4. The apparatus of claim 1, wherein at least one of said tubes provides a recess portion of constricted diameter.

5. The apparatus of claim 1 further comprising a rod threadedly connected to the safe door tumbler core for movement therewith, said rod having a reduced end projecting beyond the inside of the safe door and beyond said tubes and forming a shoulder at its inner end for connecting to a pair of metal pieces, with said metal pieces extending laterally from said elongated rod on opposite sides of said plurality of tubes, said elongated rod and said metal pieces being movable with the safe door tumbler core inwardly and outwardly with respect to the safe door.

6. The apparatus of claim 1 wherein each piece comprises a metal plate of sufficient length to extend across the width of the entire plurality of said tubes held fast by said threaded rod through a hole in each said metal plate.

7. The apparatus of claim 1 in which there is a compression spring between said metal plates to prevent said plates from rattling upon normal use of safe door.

* * * * *